US006820827B1

(12) United States Patent
Boecking

(10) Patent No.: US 6,820,827 B1
(45) Date of Patent: Nov. 23, 2004

(54) INJECTOR FOR A FUEL INJECTION SYSTEM FOR INTERNAL COMBUSTION ENGINES, HAVING A NOZZLE NEEDLE PROTRUDING INTO THE VALVE CONTROL CHAMBER

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 254 days.

(21) Appl. No.: 09/868,039

(22) PCT Filed: Oct. 12, 2000

(86) PCT No.: PCT/DE00/03597

§ 371 (c)(1),
(2), (4) Date: Sep. 5, 2001

(87) PCT Pub. No.: WO01/27463

PCT Pub. Date: Apr. 19, 2001

(30) Foreign Application Priority Data

Oct. 14, 1999 (DE) ..... 199 49 527

(51) Int. Cl.[7] ..... F02M 63/00; F02M 47/02

(52) U.S. Cl. ..... 239/533.3; 239/88; 239/89; 239/92; 239/95; 239/102.2; 239/585.1

(58) Field of Search ..... 239/88, 89, 92, 239/95, 102.2, 585.1, 585.2, 585.3, 585.4, 585.5, 533.3

(56) References Cited

U.S. PATENT DOCUMENTS

| | | | | |
|---|---|---|---|---|
| 4,566,416 A | | 1/1986 | Berchtold | |
| 5,575,425 A | * | 11/1996 | Yoshizu | 239/533.8 |
| 5,779,149 A | * | 7/1998 | Hayes, Jr. | 239/124 |
| 5,915,623 A | * | 6/1999 | Knight et al. | 239/88 |
| 6,079,641 A | * | 6/2000 | Shinogle et al. | 239/533.4 |
| 6,367,709 B2 | * | 4/2002 | Heinz et al. | 239/96 |
| 6,412,706 B1 | * | 7/2002 | Guerrassi et al. | 239/96 |

FOREIGN PATENT DOCUMENTS

| | | | | |
|---|---|---|---|---|
| DE | 4233273 A1 | * | 9/1993 | F02M/51/04 |
| DE | 19802495 A1 | * | 12/1998 | F15B/13/01 |
| EP | 0 333 097 A | | 9/1989 | |
| EP | 767304 A1 | * | 4/1997 | F02M/47/02 |
| GB | 1 320 057 A | | 6/1973 | |

* cited by examiner

*Primary Examiner*—Robin O. Evans
(74) *Attorney, Agent, or Firm*—Ronald E. Greigg

(57) ABSTRACT

An injector for a fuel injection system is proposed, having an at least partial compensation for the hydraulic forces acting on the nozzle needle. In addition, the fuel volume to be controlled is reduced, so that short control times are possible.

28 Claims, 1 Drawing Sheet

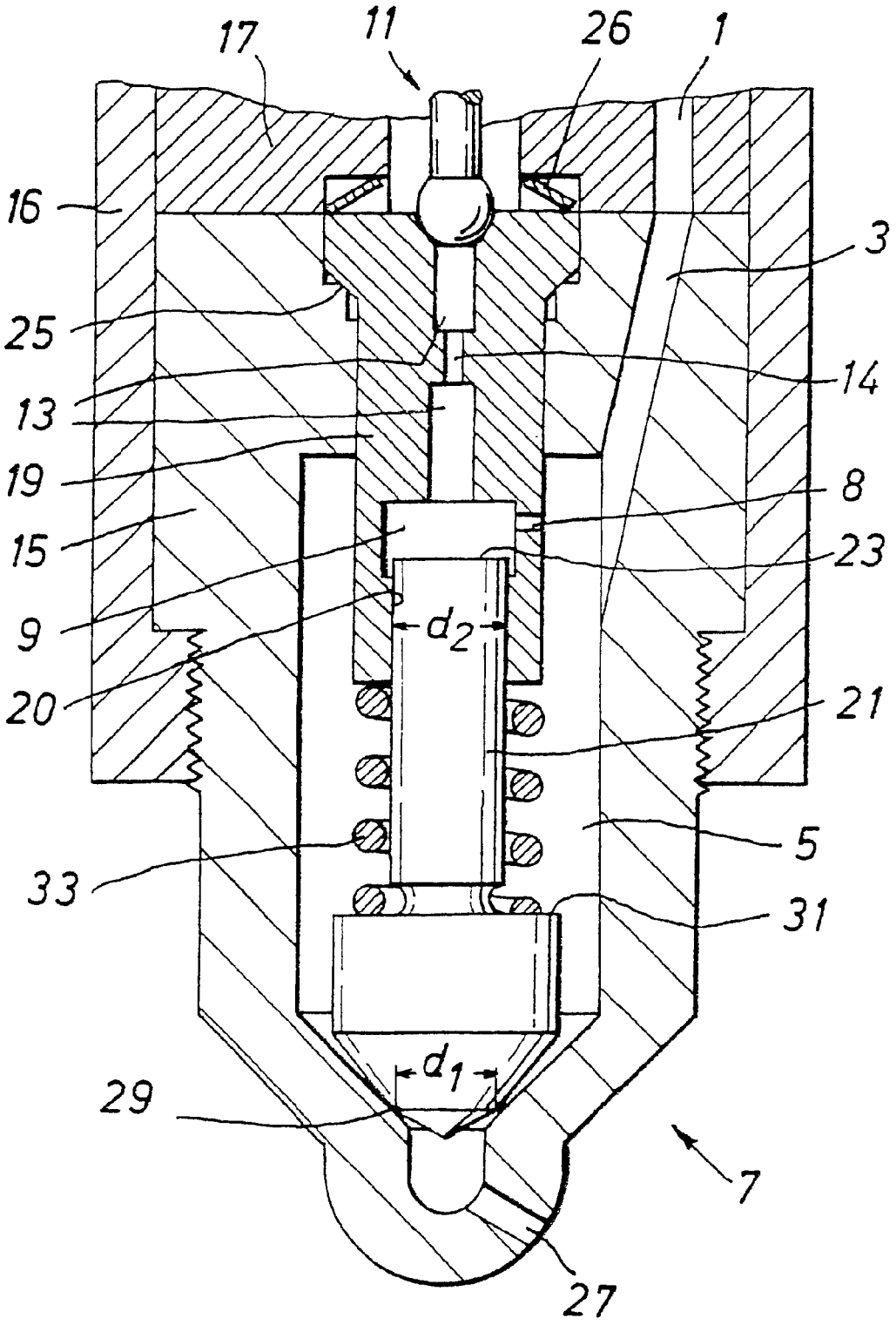
17
11
26
1
16
3
25
14
13
19
8
15
23
9
$d_2$
20
21
5
33
31
$d_1$
29
7
27

INJECTOR FOR A FUEL INJECTION SYSTEM FOR INTERNAL COMBUSTION ENGINES, HAVING A NOZZLE NEEDLE PROTRUDING INTO THE VALVE CONTROL CHAMBER

CROSS-REFERENCE TO RELATED APPLICATIONS

This application is a 35 USC application of PCT/DE 00/03597 filed on Oct. 12, 2000.

BACKGROUND OF THE INVENTION

1. Field of the Invention

The invention is based on an injector for a fuel injection system for internal combustion engines, having a nozzle needle protruding into the valve control chamber.

2. Description of the Art

Injectors that are controlled by a magnet valve or a piezoelectric actuator are known. Regardless of the type of control, improvements in emissions and fuel consumption as well as noise produced by the internal combustion engine can be attained, among other provisions, by shortening the control times of the injectors. Shortened control times mean that the metering of the injection quantities is done more precisely, and that the course of injection can be designed with greater freedom. Finally, in modern internal combustion engines in motor vehicles, the available space is increasingly tight, which demands injectors of compact structure.

OBJECTS AND SUMMARY OF THE INVENTION

It is the primary object of the invention to furnish an injector for a fuel injection system for internal combustion engines whose control times are shortened and whose external dimensions are especially compact.

This object is attained according to the invention by an injector for a fuel injection system for internal combustion engines, having a valve control chamber controlling a nozzle needle, in which the valve control chamber is defined by an end face of the nozzle needle.

This injector has the advantage that by the omission of a long thrust rod and a valve piston, the number of components and the mass inertia of the moving parts of the injector are reduced. This makes short control times possible. In addition, the valve control chamber can be brought closer to the injection nozzle, making thinner nozzle needles possible as well. This effect contributes to a further reduction in the moving masses inside the injector.

With the omission of multiple components and the possible reduction in size of the components that remain, a marked reduction in the structural size of the injector is attained. The diameter ratios of the injector of the injection are approximately equivalent to those of an injection nozzle of the prior art.

Furthermore, in the version of the injector according to the invention, no leakage can occur in the closed state, so that there is also no need to provide a leaking oil outlet.

In a variant of the invention, it is provided that the valve control chamber is disposed in a valve body, so that the injector can be produced simply and economically.

In another version of the invention, the valve body protrudes into a pressure chamber, so that a compact design of the injector is attained and the number of sealing points remains low.

The invention furthermore provides that the pressure chamber communicates with a high-pressure fuel reservoir via an inlet conduit; that the valve control chamber communicates at least indirectly with a high-pressure fuel reservoir via an inlet throttle; and that the valve control chamber communicates with the pressure chamber via an inlet throttle, so that the requisite hydraulic connections between the valve control chamber, pressure chamber and high-pressure fuel reservoir can be achieved in a simple way.

The invention also provides that the valve control chamber can be made to communicate with a fuel return, via an outlet conduit, an outlet throttle, and a control valve, in particular a 2/2-way control valve or 2/3-way control valve, so that the pressure in the valve control chamber can be reduced by opening the control valve. As a consequence, the nozzle needle uncovers the sealing seat, and the injection begins.

A variant of the invention provides that the outlet conduit and an outlet throttle are disposed in the valve body, so that a further reduction in the requisite installation space is attained.

Further features of the invention provide that a closing spring braced against the valve body and at least indirectly against the nozzle needle is present in the pressure chamber; the closing spring is braced against a shoulder of the nozzle needle; or that a closing spring braced against the injector and against the nozzle needle is present in the valve control chamber, so that in the absence of fuel pressure the injector is always closed, and thus the uncontrolled outflow of fuel into the combustion chamber is prevented.

In one embodiment of the invention, it is provided that the diameter of the end face of the nozzle needle is greater than the diameter of the sealing line between the nozzle needle and a nozzle needle seat, so that for the same pressure in the valve control chamber and pressure chamber, the resultant hydraulic force always brings about a closure of the injector.

Further in the invention, it is provided that the control valve is actuated by a piezoelectric actuator, so that the control times of the injector of the invention are shortened further.

The object stated above is also attained by a fuel injection system for internal combustion engines, having a high-pressure fuel pump and having at least one injector having a valve control chamber controlling a nozzle needle, characterized in that the valve control chamber is defined by an end face of the nozzle needle, so that the fuel injection system of the invention can be used in internal combustion engines in which both a compact design and very short control times are required.

In a variant of the invention, the fuel injection system has a high-pressure fuel reservoir, so that the advantages of the injector according to the invention also benefit common rail fuel injection systems.

BRIEF DESCRIPTION OF THE DRAWING

Further features and advantages of the invention can be learned from the ensuing description, taken with the single FIGURE of the drawing which is a fragmentary cross section through an 309 injection of the invention.

DESCRIPTION OF THE PREFERRED EMBODIMENT

Referring now to the drawing in detail, in an injector of the invention. Via a high-pressure connection 1, the fuel, not shown, is carried through an inlet conduit 3 into a pressure chamber 5 of an injection nozzle 7. The fuel originates in and has the presure of the high-pressure fuel reservoir (common rail), not shown. Via an inlet throttle 8, a valve control chamber 9 communicates with the pressure chamber 5. Via a control valve 11, shown in only fragmentary fashion, the valve control chamber 9 can be made to communicate with a pressureless fuel return, not shown. Between the valve control chamber 9 and the control valve 11, there are an outlet conduit 13 and an outlet throttle 14.

The housing 15 of the injector is connected by a union nut 16 to a cap 17. The cap 17 furthermore fixes a valve body 19 that protrudes into the pressure chamber 5. In the valve body 19, there is a guide bore 20, having the diameter $d_2$, for a nozzle needle 21. The valve control chamber 9 disposed in the valve body 19 is defined by an end face 23 of the nozzle needle.

Between the valve body 19 and the housing 15, there is a conical sealing seat 25, which seals off the pressure chamber 5 from its surroundings. A cup spring 26 fastened between the cap 17 and the valve body 19 presses the valve body 19 permanently and with constant force against the sealing seat 25.

The nozzle needle 21 prevents the fuel, which is under pressure, from flowing between injections out of the injection nozzle 7 through an injection port 27 into the combustion chamber, not shown. This is accomplished in that the nozzle needle 21 is pressed into a nozzle needle seat 29 and thus seals off the inlet conduit 3 from the combustion chamber, not shown. A circular sealing line forms between the nozzle needle 21 and the nozzle needle seat 29. The diameter of the sealing line is designated as $d_1$.

A closing spring 33 is present between a shoulder 31 of the nozzle needle 21 and the valve body 19. The spring assures that the nozzle needle 21 is always closed when the fuel lacks any overpressure.

When the control valve 11 is closed, the same pressure prevails in both the valve control chamber 9 and the pressure chamber 5. Via the end face 23, this pressure exerts a hydraulic force acting on the nozzle needle 21 in the direction of the nozzle needle seat 29. The same pressure exerts a hydraulic force, acting in the opposite direction, on the annular face defined by the diameters $d_1$ and of nozzle needle 21. The resultant hydraulic force acts on the nozzle needle 21 in the direction of the nozzle needle seat 29, because the end face 23 is larger than the annular face defined by the diameters $d_1$ and $d_2$.

The injection nozzle 7 opens when the control valve 11 is opened and as a consequence the pressure in the valve control chamber 9 collapses. In that case, the resultant hydraulic force acts in the direction of the control valve 11 and lifts the nozzle needle 21 from the nozzle needle seat 29. The fuel can thus flow out of the pressure chamber 5 into the combustion chamber via the injection port 27, and the injection begins.

When the control valve 11, which can be embodied as a 2/2-way control valve or a 2/3-way control valve, closes again, a high pressure builds up again in the valve control chamber 9, and this high pressure is equal to the pressure in the pressure chamber 5, so that the resultant hydraulic force presses the nozzle needle 21 back into the nozzle needle seat 29, and the injection ends.

An especially advantageous feature of the injector of the invention is that it is very compact in structure. The diameter of an injector of the invention is equivalent to that of an injection nozzle of the prior art. Furthermore, the masses of the moving parts are very low, since a valve piston and a thrust rod can be omitted and the nozzle needle has very small dimensions. This leads to very short control times of the injector, which can be fully utilized particularly conjunction with a piezoelectric actuator-actuated control valve 11. The tiniest possible preinjection quantities can for instance be realized. The low number of components also has cost advantages for production. Finally, no leakage losses occur, either.

The foregoing relates to preferred exemplary embodiments of the invention, it being understood that other variants and embodiments thereof are possible within the spirit and scope of the invention, the latter being defined by the appended claims.

I claim:

1. An injector for a fuel injection system for internal combustion engines comprising a nozzle needle (21), a valve control chamber (9) controlling said nozzle needle (21), the valve control chamber (9) defined by an end face (23) of said nozzle needle (21), further comprising a valve body (19), said valve control chamber (9) being disposed in said valve body (19), and wherein said valve body (19) is adapted to protrude into a pressure chamber (5).

2. The injector of claim 1, further comprising an inlet conduit (3) connecting said pressure chamber (5) with a high-pressure fuel reservoir.

3. The injector of claim 1, further comprising an inlet throttle (8), said valve control chamber (9) communicating at least indirectly with a high-pressure fuel reservoir via said inlet throttle (8).

4. The injector of claim 1, further comprising an inlet throttle (8), said valve control chamber (9) communicating with said pressure chamber (5) via said inlet throttle (8).

5. The injector of claim 1, further comprising a fuel return, an outlet conduit (13) connected with said fuel return, an outlet throttle (14), and a 2/2-way control valve (11) or 2/3-way control valve (11), whereby said valve control chamber can be made to communicate with said fuel return.

6. The injector of claim 1, further comprising an outlet throttle, said outlet conduit and said outlet conduit (13) and an outlet throttle (14) outlet throttle being disposed in said valve body (19).

7. The injector of claim 1, further comprising a closing spring (33) in said pressure chamber, said closing spring being braced against the valve body (19) and at least indirectly against the nozzle needle (21) in the pressure chamber (5).

8. The injector of claim 7, wherein said closing spring (33) is braced against a shoulder (31) on the nozzle needle (21).

9. The injector of claim 1, further comprising a closing spring (33), said closing spring being braced against said injector and against said nozzle needle (21) in the valve control chamber (9).

10. The injector of claim 1, further comprising a nozzle needle seat (29), and wherein said nozzle needle (21) has an end face diameter ($d_2$) which is greater than the diameter ($d_1$) of the sealing line between the nozzle needle (21) and a nozzle needle seat (29).

11. The injector of claim 5, further comprising a piezoelectric actuator, said control valve (11) being actuated by the piezoelectric actuator.

12. The injector of claim 1, further comprising an inlet conduit (3) connecting said pressure chamber (5) with a high-pressure fuel reservoir.

13. The injector of claim 1, further comprising an inlet throttle (8), said valve control chamber (9) communicating at least indirectly with a high-pressure fuel reservoir via said inlet throttle (8).

14. The injector of claim 2, further comprising an inlet throttle (8), said valve control chamber (9) communicating at least indirectly with a high-pressure fuel reservoir via said inlet throttle (8).

15. The injector of claim 1, further comprising an inlet throttle (8), said valve control chamber (9) communicating with said pressure chamber (5) via said inlet throttle (8).

16. The injector of claim 2, further comprising an inlet throttle (8), said valve control chamber (9) communicating with said pressure chamber (5) via said inlet throttle (8).

17. The injector of claim 3, further comprising an inlet throttle (8), said valve control chamber (9) communicating with said pressure chamber (5) via said inlet throttle (8).

18. The injector of claim 1, further comprising a fuel return, an outlet conduit (13) connected with said fuel return, an outlet throttle (14), and a 2/2-way control valve (11) or 2/3-way control valve (11), whereby said valve control chamber can be made to communicate with said fuel return.

19. The injector of claim 2, further comprising a fuel return, an outlet conduit (13) connected with said fuel return, an outlet throttle (14), and a 2/2-way control valve (11) or 2/3-way control valve (11), whereby said valve control chamber can be made to communicate with said fuel return.

20. The injector of claim 5, further comprising an outlet throttle, said outlet conduit and said outlet conduit (13) and an outlet throttle (14) outlet throttle being disposed in said valve body (19).

21. The injector of claim 5, further comprising a closing spring (33) in said pressure chamber, said closing spring being braced against the valve body (19) and at least indirectly against the nozzle needle (21) in the pressure chamber (5).

22. The injector of claim 6, further comprising a closing spring (33) in said pressure chamber, said closing spring being braced against the valve body (19) and at least indirectly against the nozzle needle (21) in the pressure chamber (5).

23. The injector of claim 1, further comprising a closing spring (33), said closing spring being braced against said injector and against said nozzle needle (21) in the valve control chamber (9).

24. The injector of claim 9, further comprising a nozzle needle seat (29), and wherein said nozzle needle (21) has an end face diameter ($d_2$) which is greater than the diameter ($d_1$) of the sealing line between the nozzle needle (21) and a nozzle needle seat (29).

25. The injector of claim 1, where the control valve (11) is actuated by a piezoelectric actuator.

26. The injector of claim 10, where the control valve (11) is actuated by a piezoelectric actuator.

27. In a fuel system for internal combustion engines, having a high-pressure fuel pump and having at least one injector having a valve body (19), a pressure chamber (5), and a valve control chamber (9) controlling a nozzle needle (21), wherein the valve control chamber (9) is defined by an end face (23) of the nozzle needle (21), said valve control chamber (9) being disposed in said valve body (19), and said valve body (19) is adapted to protrude into said pressure chamber (5).

28. The fuel injection system of claim 27, therein the fuel injection system has a high-pressure fuel reservoir.

* * * * *